US006553918B2

(12) United States Patent
Bieza

(10) Patent No.: US 6,553,918 B2
(45) Date of Patent: Apr. 29, 2003

(54) MOBILE WRITING STAND

(75) Inventor: Mark Jeffery Bieza, Lake Forest, CA (US)

(73) Assignee: Mark J Bieza, Lake Forest, CA (US)

( * ) Notice: Subject to any disclaimer, the term of this patent is extended or adjusted under 35 U.S.C. 154(b) by 0 days.

(21) Appl. No.: 10/029,011

(22) Filed: Dec. 21, 2001

(65) Prior Publication Data

US 2002/0078862 A1 Jun. 27, 2002

Related U.S. Application Data

(60) Provisional application No. 60/258,295, filed on Dec. 27, 2000.

(51) Int. Cl.[7] ..... A47B 23/00
(52) U.S. Cl. ..... 108/43
(58) Field of Search ..... 108/43, 44, 1, 108/42

(56) References Cited

U.S. PATENT DOCUMENTS

| | | | | |
|---|---|---|---|---|
| 925,284 | A | * | 6/1909 | Buck |
| 951,145 | A | | 3/1910 | McGenniss |
| 2,908,465 | A | | 10/1959 | Lykes |
| 3,698,328 | A | | 10/1972 | Weir |
| 3,730,077 | A | * | 5/1973 | Seldon |
| 3,750,312 | A | * | 8/1973 | Bucher |
| 3,790,770 | A | | 2/1974 | Stern |
| 3,791,314 | A | * | 2/1974 | Berretta |
| 3,894,709 | A | | 7/1975 | Weir |
| 3,906,648 | A | * | 9/1975 | Bard |
| 4,292,748 | A | * | 10/1981 | Miller |
| 4,311,101 | A | | 1/1982 | de Almagro |
| 4,431,156 | A | | 2/1984 | Mena |
| 5,009,379 | A | | 4/1991 | Sadler |
| D323,752 | S | | 2/1992 | Montagner |
| 5,293,825 | A | | 3/1994 | Cauffiel |
| D348,081 | S | | 6/1994 | Cady |
| 5,359,741 | A | | 11/1994 | Lang |
| 5,606,917 | A | | 3/1997 | Cauffiel |
| 5,607,091 | A | | 3/1997 | Musacchia |
| 5,642,541 | A | | 7/1997 | Corbin |
| 6,116,165 | A | | 9/2000 | Kadesky |
| 6,253,688 | B1 | | 7/2001 | Lor |

FOREIGN PATENT DOCUMENTS

| | | | |
|---|---|---|---|
| DE | 2156757 | * | 5/1973 |

* cited by examiner

*Primary Examiner*—Jose V. Chen

(57) ABSTRACT

A mobile work stand includes a base of a size and shape enabling the base to be positioned between the user's thigh and a seating surface and a top having a flat surface. A connector post extends between the top and base and a bracket disposed on the base is provided for removably attaching a connector post and enabling the connector post to be moved between the position extending upwardly from the base in a position generally parallel with the base. A coupling is provided and disposed between the top and connector post for enabling the top to swivel about the connector post.

15 Claims, 3 Drawing Sheets

MOBILE WRITING STAND

This application claims the benefit of Provisional application Ser. No. 60/258,295, filed Dec. 27, 2000.

The present invention is generally related to portable work tables and is more particularly directed to mobile work or writing stands.

There is often a need for a mobile or portable table to facilitate writing when a standard desk, tabletop or other suitable writing surface is not available. Such a situation often arises, in particular, in the case for taking notes during jury service. While pens and pencils are often provided to jurors, the taking of notes is often inconvenient because a suitable writing surface is not available.

In addition, impromptu use of a lap computer is facilitated through the use of a portable table or work surface.

Heretofore, many tables have been designed for facilitating the reading of documents or books. Such devices are typically intended for bed use or for handicapped individuals.

These devices however, tend to be complex, and for the most part, require attachment to a fixture such as a bed, chair or the like in order to support a surface for holding a book and allow placement of the book at a desired inclination for reading.

None of the prior art devices however, are easily collapsed, and further, do not provide storage space for receiving writing implements and the like.

The present invention provides for a mobile work or writing stand which is easily collapsible for transport, and further, is easily transported with stored writing implements.

SUMMARY OF THE INVENTION

A mobile work stand in accordance with the present invention generally includes a base of a size and shape enabling the base to be positioned between the user's thigh and a seating surface. This features enables the use of the work stand at practically any location in which the user is able to sit.

A connector post includes a bottom end and a top end and a bracket disposed on the base is provided for coupling the connector post bottom end and enabling the connector post to be moved between the position extending upwardly from a base in a position generally parallel with the base.

More particularly, the bracket includes a first socket for attaching the connector bottom end with the connector post extending upwardly from the base and a second socket for removable coupling with the connector post bottom end and for supporting the connector post in a position generally parallel to the base for storage and transport.

A top is provided, which includes a top surface along with a coupling, disposed between the top and the connector post top end, for enabling the top to swivel about the connector post. This action enables the top, along with the flat surface, to be adjusted at any desired angle relative to the user for facilitating the writing of notes or the operation of a lap top computer.

In order to provide a height adjustment, the connector port includes an upper tube and a lower tube which are telescoped together for enabling for adjustment of a distance between the base and the top. The swivel relationship between the top and the connector post also facilitates the compact storage of the work stand when the connector post is supported by the second socket in a position generally parallel to the base for storage and transport.

Preferably, the upper and lower tubes are hollow and have sufficient inside diameter for the storage of writing implements. Accordingly, the user does not need to account for separate writing implements when transporting the stand from place to place. The coupling may comprise a ball disposed on the connector post top and on a socket disposed on a top underside.

In addition, the bracket is preferably disposed adjacent to one end of the base in order to provide maximum thigh contact with the base when the stand is in position for use by a user.

Preferably, when used for writing, the stand in accordance with the present invention may utilize a clip for removable holding a paper, or paper pad, to the top of the flat surface. When used as a support for a lap top computer, the top flat surface is preferably sized for enabling support of the computer. Several tops may be provided for enabling interchanging of the tops with the base dependant upon expected use of the mobile work stand.

BRIEF DESCRIPTION OF THE DRAWINGS

The advantages and features of the present invention will be better understood by the following description when considered in conjunction with the occupying drawings in which.

DETAILED DESCRIPTION

Figure 1:
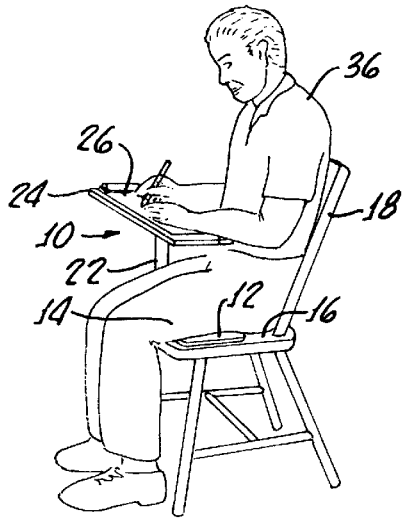
FIG. 1 is a representation of the work stand in accordance with the present invention as it may be used to advantage by a user seated in a chair.

With reference to FIGS. 1 through 6, and more specifically to FIG. 1, a mobile work stand 10 in accordance with the present invention generally includes a base 12 having a size and shape enabling the base 12 to be positioned between a user's thigh 14 and a seating surface 16 which may be provided, for example, by a chair 18.

A connector post 22 interconnects the base 12 with a top 24. The top 24 includes a flat surface 26.

As shown in the Figures, the top 24 and flat surface 26 are of sufficient size for enabling writing by a user 36 (see FIG. 1). In that regard, a clip 30 may be provided for supporting a paper, or pad of paper 32 on the surface 36.

It should be appreciated that the top 24 along with the flat surface 26 may be sized for supporting a lap top computer, not shown, or a dinner tray, also not shown.

Figure 2:
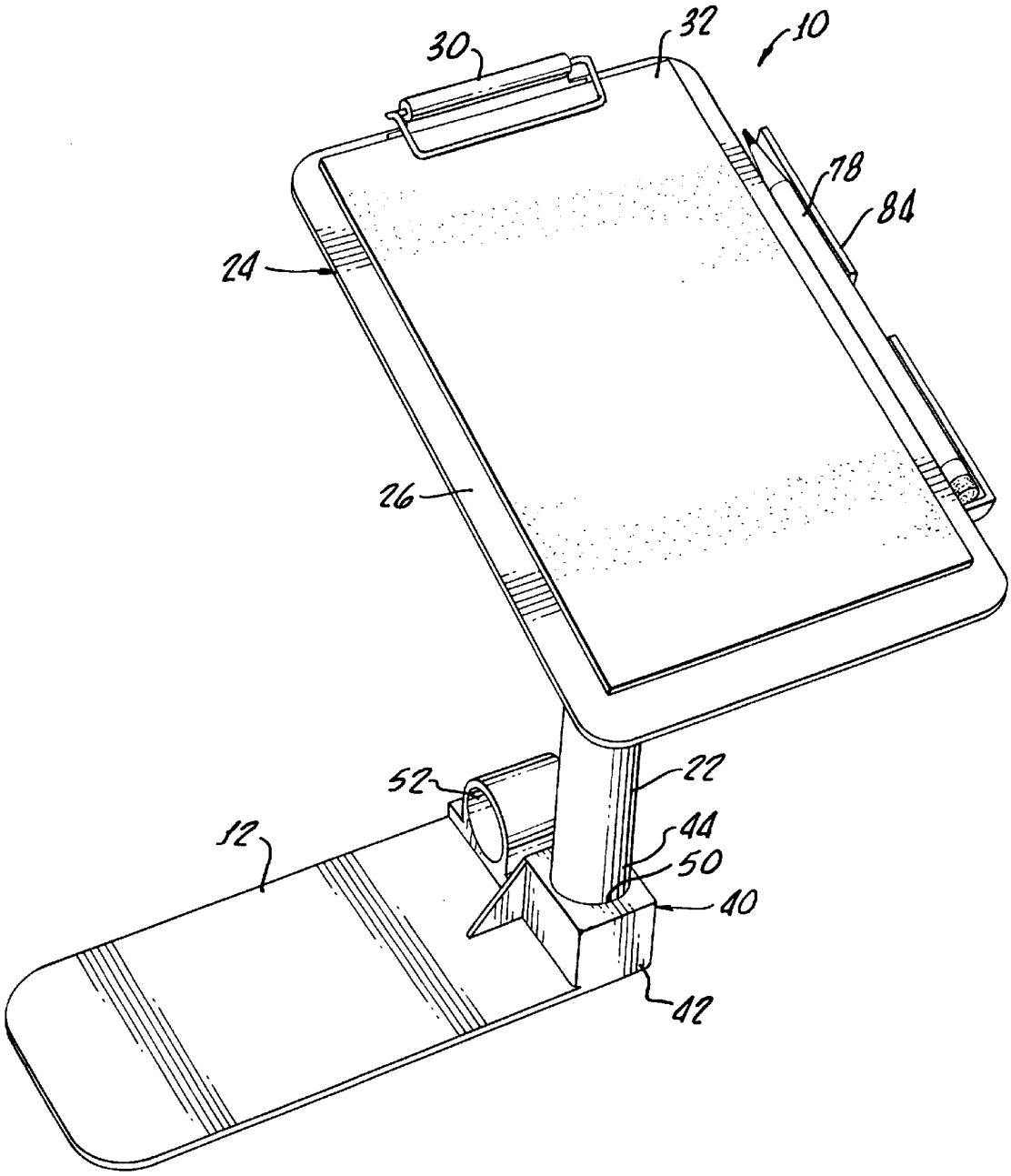
FIG. 2 is a perspective view of the present invention generally showing a base bracket and top.
Figure 3:
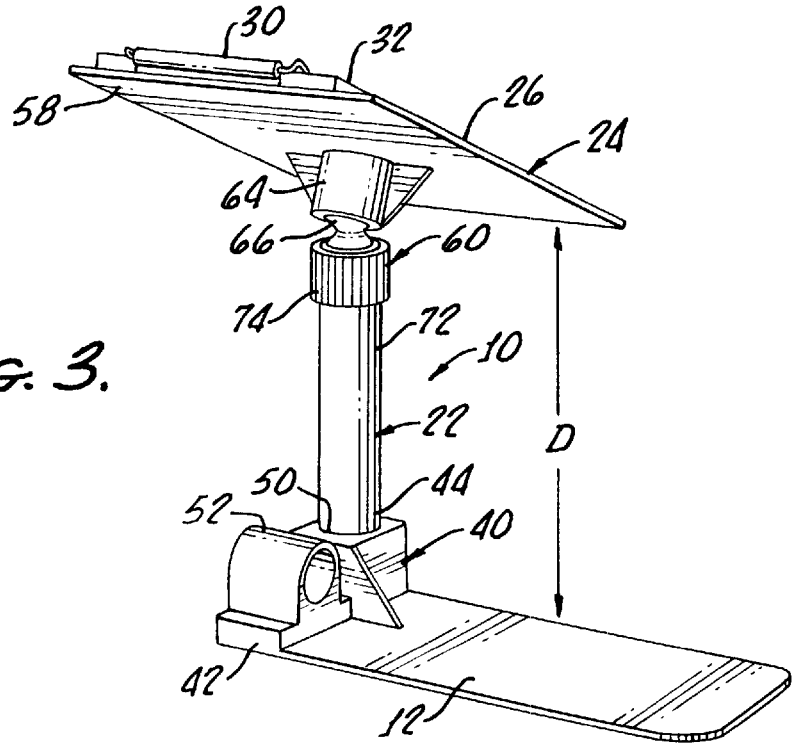
FIG. 3 is another perspective view of the stand shown in FIG. 2 when viewed from a rear position and showing a connector post adjusted to provide a specific distance or height of the top from the base.
Figure 4:
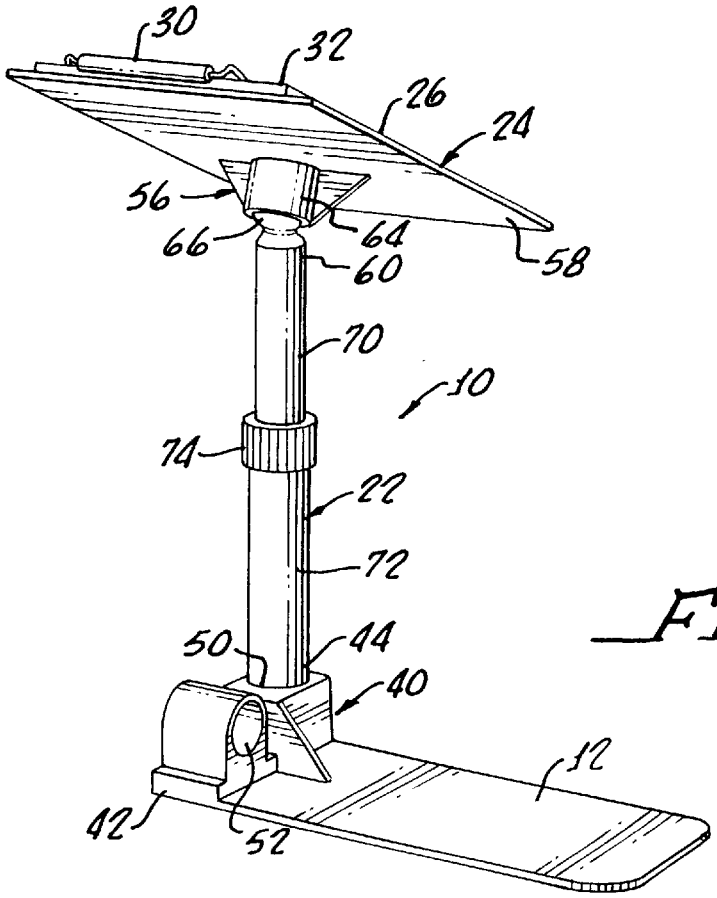
FIG. 4 is a view similar to FIG. 3 showing the connector post extended to provide a greater distance between the top and the base.

As more clearly shown in FIGS. 2–6, a bracket 40 is preferably disposed proximate one end 42 for removably attaching the connector post 22, at a bottom end 44 to the base 12 with the connector post 22 extending upwardly from the base 12, see FIGS. 2–4.

The bracket 40 is preferably integrally molded with the base, but of course can be separately attached thereto. The base is preferably formed from a suitable plastic material approximately one quarter inch thick having a width of about 5 inches and a length of about 16 inches.

This size and the shape shown in the Figures enables the base 12 to be positioned between the user's thigh 14 and the seating surface 16. Because the top 24 and connecting post may be rotatably inserted into the bracket 40, the work stand 10 is suitable for both right handed and left handed user's (not shown). As shown, the bracket 40 includes a first socket 50 formed in the bracket 40 for attaching the connector bottom end 44 with the connector post 22 extending upwardly from the base 12 and a second socket 52 for removably coupling the connector post bottom end 44 for supporting the connector post 22 in a position generally parallel to the base 12 for storage and transport, see FIGS. 5 and 6. This structure enables collapsing or reconfiguring, the work stand 10 for storage and transport.

Figure 5:
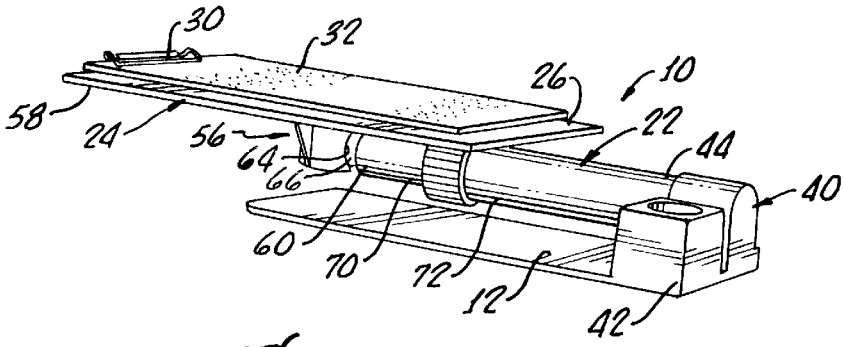
FIG. 5 is yet another perspective view of the present invention in which the connector post is moved from one socket of a bracket to another enabling the connector post to be stored generally parallel to the base with the top swiveled to a parallel relationship for enabling compact storage and transport of the stand.
Figure 6:
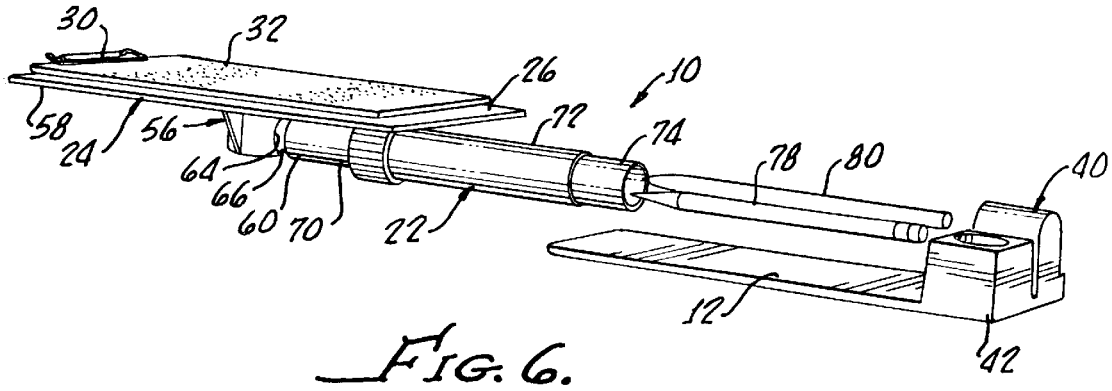
FIG. 6 is an exploded perspective view similar to those shown in FIG. 5 showing the use of the connector post for storage of the writing implements.

In that regard, a coupling 56, see FIGS. 3–6, disposed between the top 24 on an underside 58 and a connector post top end 60 enables the top 24 to be swiveled about the connector post 22. Preferably, the coupling 56 includes a socket molded to the top underside 58 and a ball 66 molded into the connector post top end 60. This enables the top 24 to be swiveled, or tilted to adjust for an angle suitable for use by the user 36 for either writing, operation of lap top computer, or support for food items, not shown. In addition, the swivel arrangement provided by the coupling 56 enables the top 24 to be aligned in a generally parallel relationship with the base 12 as shown in FIGS. 5 and 6 for storage and transport of the work stand 10.

With specific reference to FIGS. 3 and 4, the connector post preferably includes an upper tube 70 and a lower tube 72 which are telescoped together for enabling adjustment of a distance, D, between the base 12 and the top 24, see FIGS. 3 and 4. The upper and lower tubes 70, 72 are releasably affixed together by a torque ring 74.

As shown in FIG. 6, the tubes 70, 72 may be hollow and of sufficient inside diameter for the storage of writing implements such as, pencils 78 and pens 80. This convenient storage enables the user 36 to transport the work stand 10 with paper 32 and writing implements 78, 80 as a single unit for convenience.

As shown in FIG. 2, the top 24 may alternatively include a pencil clip 84 for temporarily holding the pencil for ready access while the top 24 is supported by the connecting post 24 and base 12 for use by the user 36.

Although there has been hereinabove described a particular arrangement of a mobile work stand or writing stand in accordance with the present invention for the purpose of illustrating the manner in which the invention may be used to advantage, it should be appreciated that it is not limited thereto. Accordingly, any and all modifications, variations, or equivalent arrangements which may occur to those skilled in the art, should be considered to be within the scope of the present invention as defined in the appended claims.

What is claimed is:

1. A mobile work stand comprising:

a base of a size and shape enabling the base to be positioned between a user's thigh and a seating surface;

a connector post having a bottom end and a top end, said connector post comprising an upper tube and a lower tube telescoped together for enabling adjustment of distance between said base and said top;

a bracket disposed on said base for removably attaching the connector post bottom end to said base with said connector post extending upwardly from said base, said bracket comprising a first socket for attaching the connector bottom end with said connector post extending upwardly from said base and a second socket for removing coupling with the connector post bottom end supporting said connector post in a position generally parallel to said base for storage and transport;

a top having a flat surface; and a coupling disposed between said top and the connector post top end, for enabling said top to swivel about said connector post.

2. The work stand according to claim 1 wherein the upper and lower tubes are hollow and have sufficient inside diameter for the storage of writing implements.

3. The work stand according to claim 2 wherein said coupling comprises a ball disposed on the connection post top end and a socket disposed on a top underside.

4. The work stand according to claim 3 wherein said bracket is disposed adjacent one end of said base.

5. The work stand according to claim 4 further comprising a clip for removably holding a paper to the top flat surface.

6. The work stand according to claim 4 wherein the top flat surface is of a size enabling support of a lap top computer.

7. A mobile work stand comprising:

a base of a size and shape enabling the base to be positioned between a user's thigh and a seating surface;

a connector post having a bottom end and a top end, said connector post comprising an upper tube and a lower tube telescoped together for enabling adjustment of distance between said base and said top;

a bracket disposed on said base for coupling to the connector post bottom end and enabling said connector post to be moved between a position extending upwardly from said base and a position generally parallel with said base, said bracket comprising a first socket for attaching the connector bottom end with said connector post extending upwardly from said base and a second socket for removably coupling with the connector post bottom end for supporting said connection post in a position generally parallel to said base for storage and transport;

a top having a flat surface; and a coupling disposed between said top and the connector port top end for enabling said top to swivel about said connection post.

8. The work stand according to claim 7 wherein the upper end lower tubes are hollow and have sufficient inside diameter for the storage of writing implements.

9. The work stand according to claim 8 wherein said coupling comprises a ball disposed in the connector post top end and a socket disposed on a top underside.

10. The work stand according to claim 9 wherein said bracket is disposed adjacent one end of said base.

11. The work stand according to claim 10 wherein the top flat surface is of a size enabling support of a lap top computer.

12. A mobile writing stand comprising:

a base of a size and shape enabling the base to be positioned between a user's thigh and a seating surface;

a connector post having a bottom end and a top end, said connector post comprising an upper tube and a lower tube telescoped together for enabling adjustment of distance between said base and said top;

a bracket disposed on said base for removably attaching the connector post between end to said base with said connector post extending upwardly from said base, said bracket comprising a first socket for attaching the connector a first socket for attaching the connector bottom end with said connector post extending upwardly from said base and a second socket for removably coupling with the connector post bottom end for supporting said connection post in a position generally parallel to said base for storage and transport;

a top having a flat surface with a clip for releasably holding a paper to said flat surface; and a coupling, disposed between said top and the connector post top end, for enabling said top to swivel about said connector post.

13. The writing stand according to claim 12 wherein the upper and lower tubes are hollow and have sufficient inside diameter for the storage of writing implements.

14. The writing stand according to claim 13 where said coupling comprises a ball disposed on the connector port top end and a socket disposed on a top underside.

15. The writing stand according to claim 14 wherein said bracket is disposed adjacent one end of said base.

* * * * *